US010808489B2

(12) United States Patent
Hiorth

(10) Patent No.: US 10,808,489 B2
(45) Date of Patent: Oct. 20, 2020

(54) WELL TOOL DEVICE WITH A FRANGIBLE GLASS BODY

(71) Applicant: Interwell Norway AS, Hafrsfjord (NO)

(72) Inventor: Espen Hiorth, Trondheim (NO)

(73) Assignee: Interwell Norway AS, Hafrsfjord (NO)

( * ) Notice: Subject to any disclaimer, the term of this patent is extended or adjusted under 35 U.S.C. 154(b) by 16 days.

(21) Appl. No.: 15/777,758

(22) PCT Filed: Jan. 2, 2017

(86) PCT No.: PCT/EP2017/050024

§ 371 (c)(1),
(2) Date: May 21, 2018

(87) PCT Pub. No.: WO2017/118618

PCT Pub. Date: Jul. 13, 2017

(65) Prior Publication Data

US 2018/0334878 A1 Nov. 22, 2018

(30) Foreign Application Priority Data

Jan. 4, 2016 (NO) ..... 20160002

(51) Int. Cl.
*E21B 33/12* (2006.01)
*E21B 33/134* (2006.01)
*E21B 34/06* (2006.01)

(52) U.S. Cl.
CPC ..... *E21B 33/1208* (2013.01); *E21B 33/12* (2013.01); *E21B 33/134* (2013.01); *E21B 34/063* (2013.01)

(58) Field of Classification Search
CPC .... E21B 33/1208; E21B 34/063; E21B 33/12; E21B 33/134; E21B 29/00
See application file for complete search history.

(56) References Cited

U.S. PATENT DOCUMENTS 5,607,017 A * 3/1997 Owens ..... E21B 33/12 166/288
6,397,950 B1 6/2002 Streich et al.
(Continued)

FOREIGN PATENT DOCUMENTS

NO 321976 B1 7/2006
NO 20130427 A1 3/2014
WO 2010/120774 A1 10/2010

OTHER PUBLICATIONS

International Search Report issued in PCT/EP2017/050024 dated Mar. 27, 2017 (2 pages).
(Continued)

*Primary Examiner* — Michael R Wills, III
(74) *Attorney, Agent, or Firm* — Osha Liang LLP

(57) ABSTRACT

A well tool device may include a housing having an inner surface defining a through bore, a frangible glass body with upper and lower chamfered supporting surfaces and a seat for supporting the frangible glass body in relation to the housing. Additionally, a sealing device is provided between the frangible disc and the seat. Further, the frangible glass body is provided as one glass body with a barrier portion supported by the seat and a neck portion protruding in the direction of the through bore, where the diameter of the neck portion is smaller than the diameter of the barrier portion.

18 Claims, 8 Drawing Sheets

(56) References Cited

U.S. PATENT DOCUMENTS

| | | | | |
|---|---|---|---|---|
| 7,712,521 | B2 * | 5/2010 | Sorensen | E21B 33/12 166/179 |
| 9,732,579 | B2 * | 8/2017 | Hiorth | E21B 33/1208 |
| 2007/0012438 | A1 | 1/2007 | Hassel-Sorensen | |
| 2007/0163776 | A1 * | 7/2007 | Sorensen | E21B 33/12 166/179 |
| 2010/0270031 | A1 | 10/2010 | Patel | |
| 2010/0282330 | A1 * | 11/2010 | Luther | A43B 1/0027 137/68.11 |
| 2010/0282469 | A1 * | 11/2010 | Richard | E21B 33/1208 166/308.1 |
| 2014/0151052 | A1 * | 6/2014 | Themig | E21B 34/063 166/308.1 |
| 2014/0311752 | A1 | 10/2014 | Streich et al. | |
| 2016/0024873 | A1 * | 1/2016 | Brandsdal | E21B 41/0021 166/386 |
| 2017/0321518 | A1 * | 11/2017 | Hiorth | E21B 33/12 |

OTHER PUBLICATIONS

Written Opinion issued in PCT/EP2017/050024 dated Mar. 27, 2017 (5 pages).
Norwegian Search Report issued in 20160002 dated Jul. 12, 2016 (2 pages).

* cited by examiner

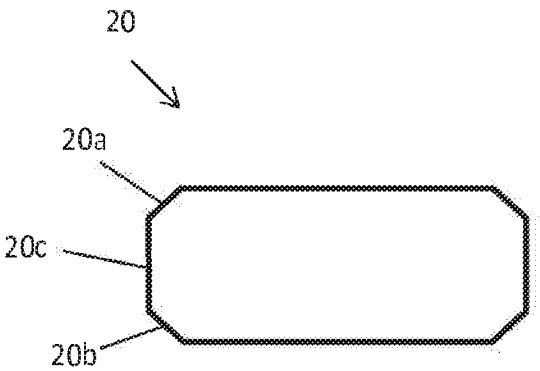
Fig. 1b: Prior art
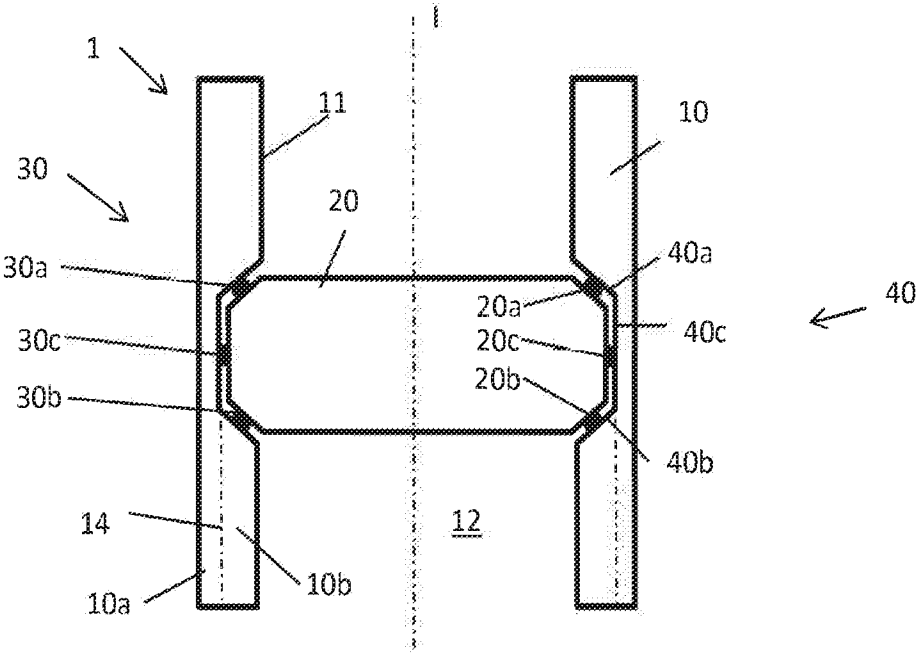
Fig. 1a: Prior art

WELL TOOL DEVICE WITH A FRANGIBLE GLASS BODY

FIELD OF THE INVENTION

The present invention relates to a well tool device with a frangible glass body.

BACKGROUND OF THE INVENTION

Frangible well plugs are commonly used in tools for oil and/or gas wells. These plugs provide a pressure barrier in the tool, for example during periodic or permanent isolation of zones in the well, during well integrity testing, etc.

These frangible well plugs have a frangible barrier element in the form of a frangible disc or other frangible bodies made from glass, hardened glass, ceramics etc. The barrier element is provided in a seat in a metal housing. The barrier element may be removed by means of various techniques, where the purpose is to disintegrate the element into small pieces.

An example of a glass plug is known from NO 321 976 (TCO AS). The plug comprises a number of layered or stratified ring discs of a given thickness, which are placed in abutment on top of one another. Between the different layers of the plug an intermediate film of plastic, felt or paper is inserted; the various glass layers may also be joined by means of lamination by an adhesive such as a glue. During use the plug will be mounted in a plug-receiving chamber in a tubing, where the underside of the plug rests in a seat at the bottom of the chamber. An explosive charge is furthermore incorporated in the top of the plug by one or more recesses being drilled out from the top of the plug, in which recesses the explosive charge(s) are placed.

Another example is known from NO 20130427(Vosstech AS). Here, the plug has one glass disc, which may be disintegrated by a radial pin or loading device being pushed into the glass disc.

With the above prior art well plugs, different types of seals are used between the metal and the glass. Often, one type of seal (typically o-ring) is used circumferentially around the glass disc to avoid fluid flow in the area between the glass disc and the metal housing. A second type of seal is used in the upper part and lower part of the seat to avoid contact between the glass disc and the metal housing, as is it known for the skilled person that such contact will cause an undesired breaking of the glass disc when the differential fluid pressure is increasing above a certain level.

There are several disadvantages with the above well tools. Some of the disintegration methods are complex and hence expensive, others, such as the use of explosives, are not desirable due to safety regulations topside.

Accordingly, the main object of the invention is to provide a well tool device with a frangible glass body which may be disintegrated in an easy and reliable way.

SUMMARY OF THE INVENTION

The present invention is defined in the appended claims 1 and 10. Aspects of the invention is defined in the dependent claims.

DETAILED DESCRIPTION

Embodiments of the invention will now be described in detail with reference to the enclosed drawings, where:

FIG. 1*a* illustrates a cross portion al view of a prior art well tool device with a frangible disc;

FIG. 1*b* illustrates a cross portion al view of the frangible disc of FIG. 1*a;*

Figure 5A:
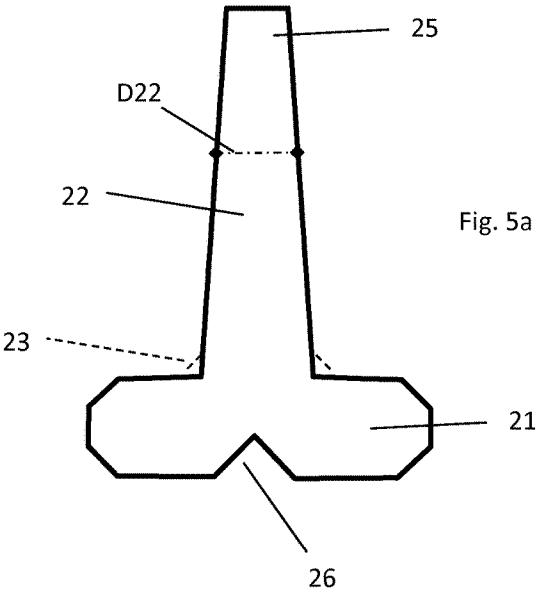
Figure 5B:
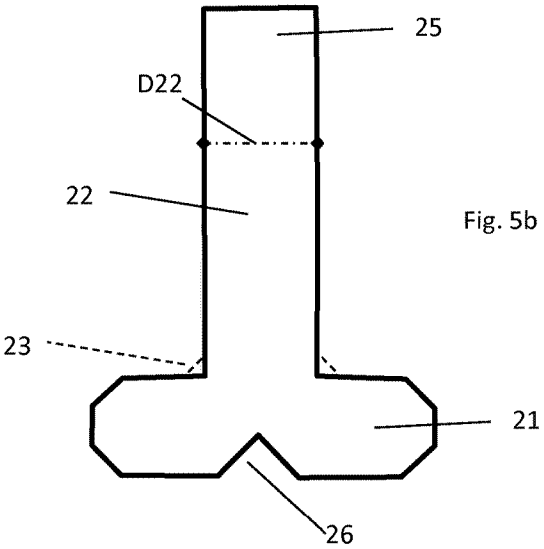
Figure 6A:
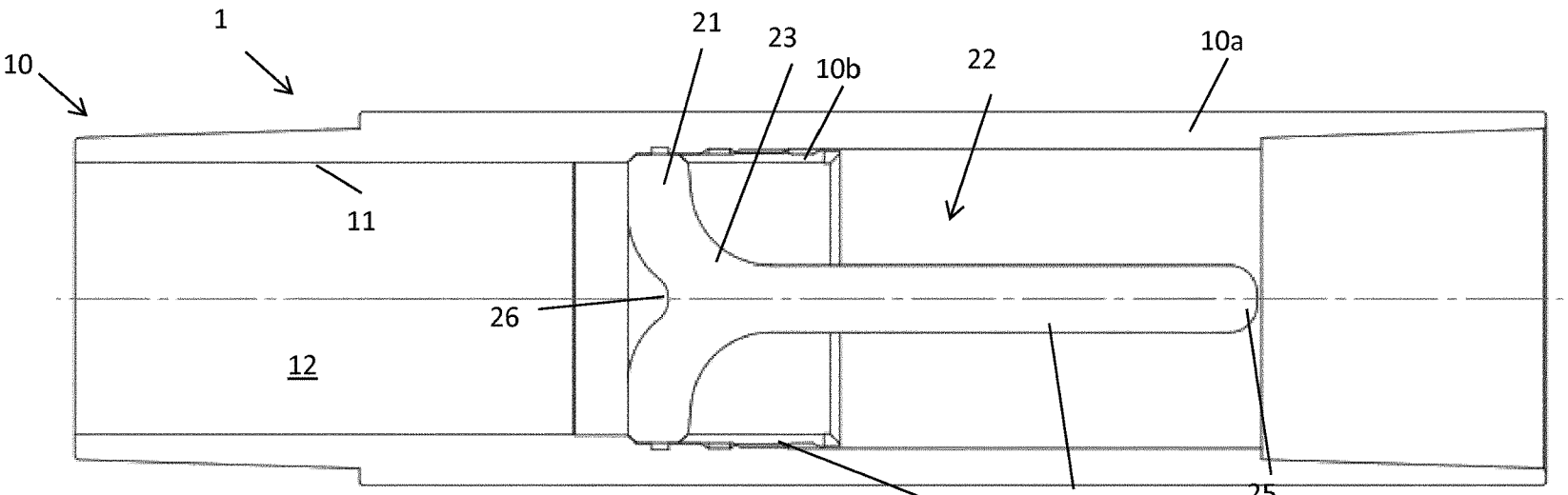
Figure 6B:
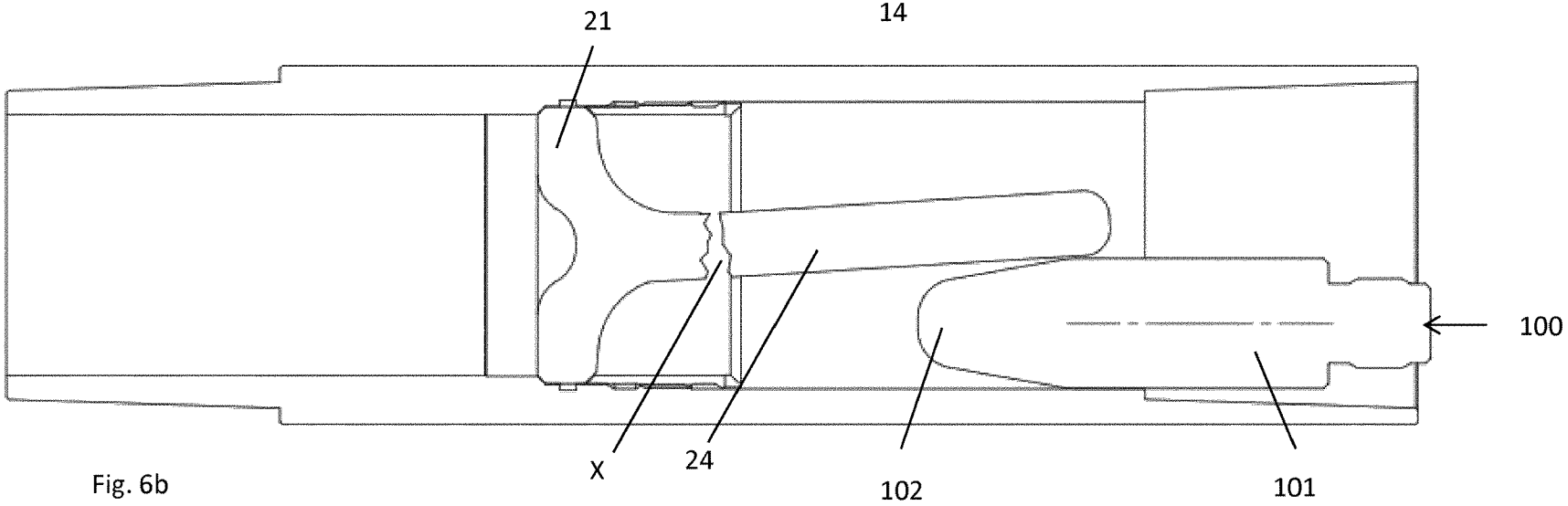
Figure 7:
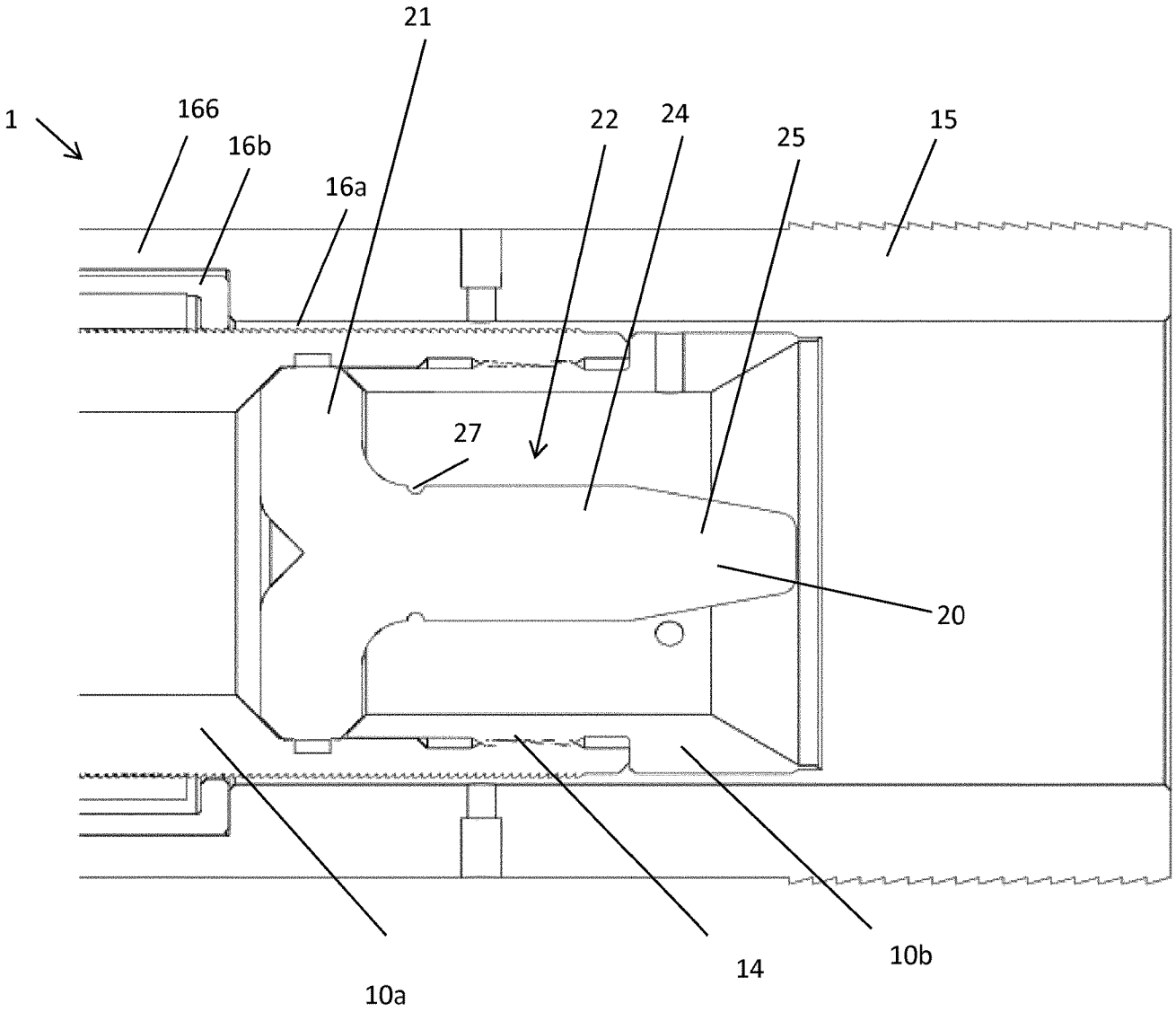
Figure 8C:
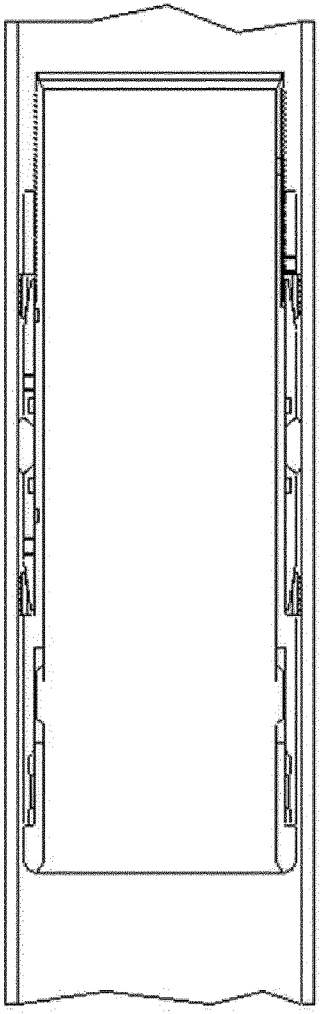
Figure 8B:
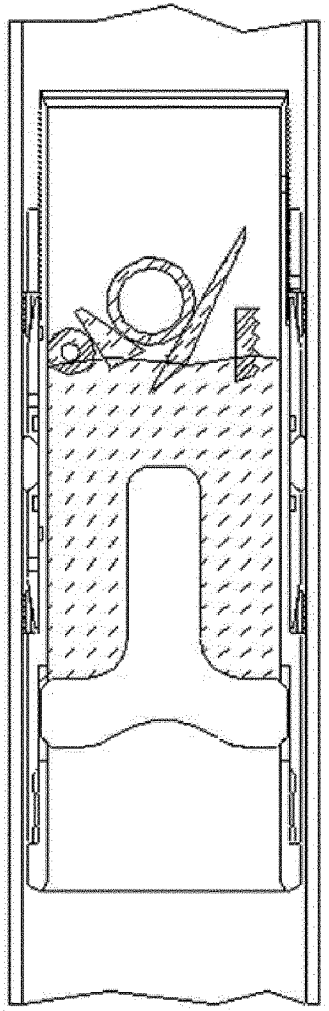
Figure 8A:
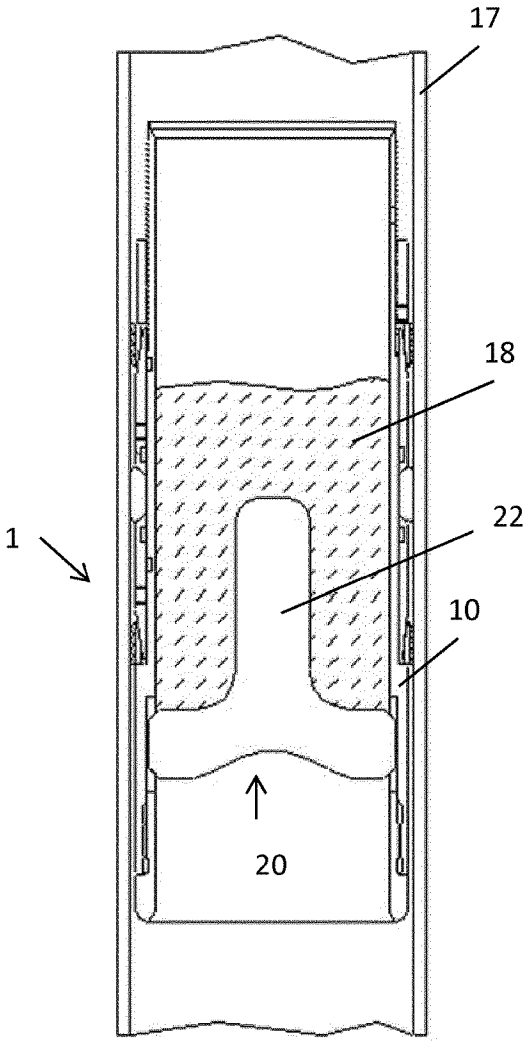
Figure 9:
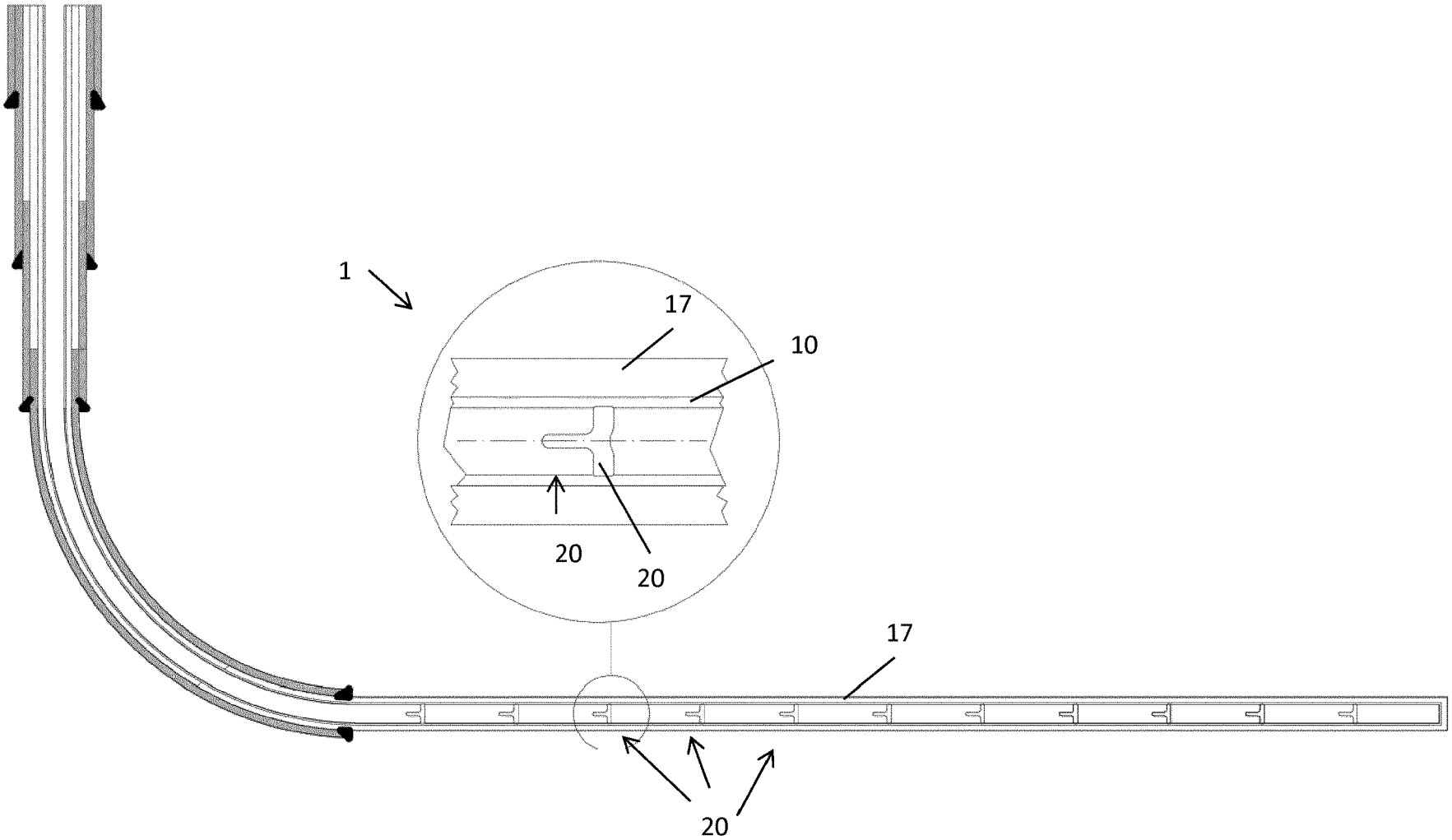

FIG. 5*a* illustrates an alternative embodiment of the invention;

FIG. 5*b* illustrates an alternative embodiment of the invention;

FIGS. 6*a* and 6*b* illustrate an alternative embodiment of the invention;

FIG. 7 illustrates yet an alternative embodiment of the invention;

FIGS. 8*a*, 8*b* and 8*c* shows an embodiment where the glass body is used as a debris catcher;

FIG. 9 illustrates an embodiment where the production tubing in a horizontal section of a well is made "buoyant" by means of one embodiment of the invention.

FIG. 10*a-f* illustrate an embodiment where glass bodies are used to temporarily seal off pre-made perforations in the tubing.

First, FIG. 1 will be described. The prior art well tool device 1 comprises a housing 1 with an inner surface 11 defining a through bore 12. A seat 40 is provided in the inner surface 11 of the housing, with an upper chamfered supporting surface 40*a*, a lower chamfered supporting surface 40*b* and a side surface 40*c* between the upper and lower chamfered supporting surfaces 40*a*, 40*b*. The side surface 40*c* is typically provided in an axial direction, i.e. parallel to the central longitudinal axis I of the well tool device 1.

A frangible glass body, in prior art often shaped as a disc 20, is provided in the seat 40, and comprises upper and lower chamfered supporting surfaces 20*a*, 20*b* and an side surface 20*c*, corresponding to the surfaces of the seat 40. In the present embodiment, the frangible disc 20 is made of a hardened glass material.

Seals, generally referred to with reference number 30, are provided between the frangible disc 20 and the seat 40. A first type of seal, typically a side sealing element such as an o-ring, is provided around the frangible disc 20 between the side surfaces 20*c*, 40*c* and is shown with reference number 30*c*. This side sealing element 30*c* prevent fluid flow in the area between the housing and the body 20.

A second type of seal is provided between the upper chamfered surfaces 20*a*, 40*a* and is hereinafter referred to as upper sealing element 30*a*. Another seal of the second type of seal is provided between the lower chamfered surfaces 20*b*, 40*b* and is hereinafter referred to as lower sealing element 30*b*. As mentioned in the introduction, the second type of seal is a contact-preventing seal to prevent contact between the glass material of the frangible disc 20 and the metal material of the seat 40.

The housing 10 typically comprises first and second housing portion s 10*a*, 10*b* connected to each other via a threaded connection indicated by the dashed line 14 in FIG. 1*a*. This is necessary for the assembly of the well tool device 1. First, the seals 30 and disc 20 are inserted into the seat 40 part of the first housing portion 10*a*, then the second housing portion 10*b* is connected to the first housing portion 10*a*, thereby locking the seals and disc to the housing 10.

It should be noted that the term "upper" is used herein to describe the side of the well tool device 1 being closest to the topside of the well, while the term "lower" is used to describe the side of the well tool device 1 being closest to the bottom of the well, when the well tool device 1 is lowered into a oil/gas well.

Figure 3:
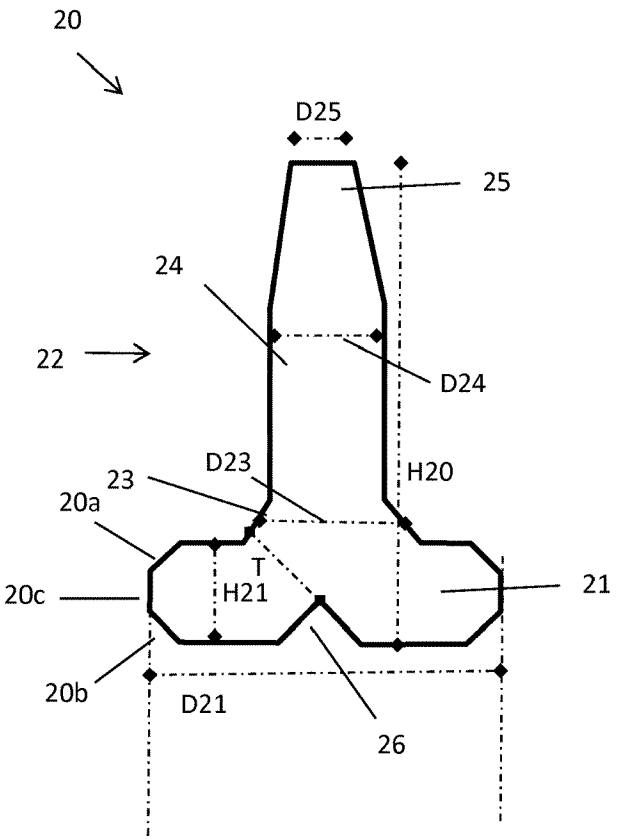
FIG. 3 illustrates a cross portion al view of the frangible glass body of FIG. 2.
Figure 2:
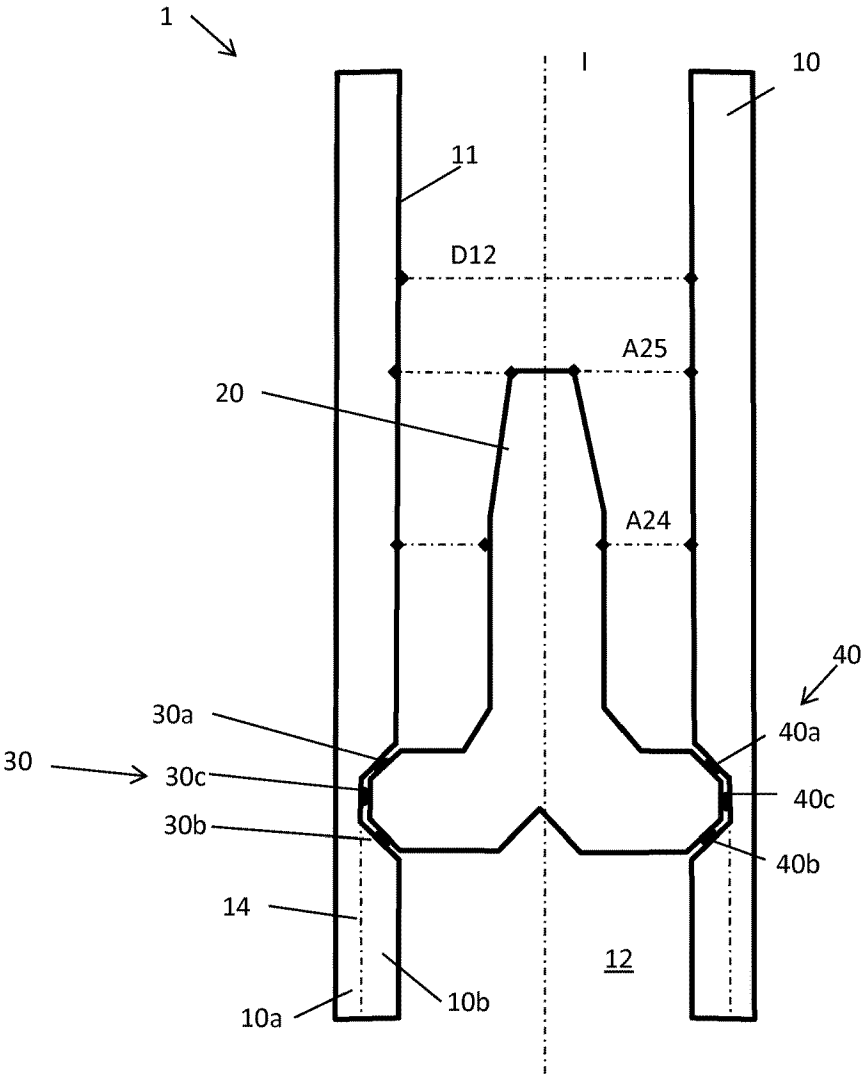
FIG. 2 illustrates a cross portion al view of a first embodiment of the well tool device.

It is now referred to FIGS. 2 and 3, illustrating a first embodiment. The well tool device 1 has several similarities with the prior art well tool 1 shown in FIGS. 1*a* and 1*b*, and those similar features will not be described herein in detail. For example the housing 10, the seat 40 and the sealing device 30 are considered known from prior art.

In the present invention, the frangible glass body 20 comprises a barrier portion 21 and a neck portion 22. It should be noted that the body 20 is provided as one glass body 20, i.e. the portions 21 and 22 are not separate glass parts connected to each other or fixed to each other.

The barrier portion 21 of the body 20 is supported by the seat 40. Hence, the barrier portion 21 is comprising the upper and lower chamfered supporting surfaces 20*a*, 20*b*. The barrier portion 21 also comprises the side surface 20*c*. Accordingly, the sealing device 30 comprising the upper and lower sealing elements 30*a*, 30*b* and the side sealing element 30*c* are provided in contact with the barrier portion 21.

The neck portion 22 is protruding in the direction of the through bore 12. As shown in FIG. 2, the diameters D24, D25 of the neck portion 22 is smaller than the diameter D21 of the barrier portion 21.

Preferably, the neck portion 22 is protruding upwardly, towards the top side of the well. In FIGS. 2 and 3, it is shown that the neck portion 22 comprises two sub-portions, a lower, cylindrical neck portion 24 and an upper, tapering neck portion 25. The upper, tapering neck portion 25 has a diameter D25 smaller than the diameter D24 of the lower portion 24. Of course, as the upper neck portion 24 is tapering, the diameter will vary depending on the distance from the barrier portion 21. In FIG. 3, the smallest diameter D25 is indicated at the top of the neck portion 22.

Preferably, the barrier portion 21 and the neck portion 22 have a coinciding center axis I. Moreover, it is preferred that the frangible glass body 20 is cylindrical symmetric around its longitudinal center axis I, i.e. the body 20 will have the same cross sectional shape when viewed from the side independent of the position of the rotation of the body 20 around the longitudinal axis I.

As float glass of sufficient quality today only is available at a thickness up to 25 mm, the present invention is not possible to produce by means of float glass. Hence, in a preferred embodiment, industrial glass is used. Industrial glass is available in rectangular blocks or cylinders. Several types of industrial glass are possible to use, for example crown glass, which is a type of optical glass typically used in lenses and other optical components. One type of such crown glass is borosilicate glass, often shortened as BK7.

In order to obtain the shape described herein, the industrial glass is heated and then shaped to the desired shape. Alternatively, the industrial glass may be grinded and polished to obtain the desired shape. It may be difficult to obtain accurate angles without grinding, therefore, the embodiment shown in FIGS. 2 and 3 comprises a transitional cylindrical portion 23 provided between the barrier portion 21 and the neck portion 22, i.e. between the barrier portion 22 and the lower neck portion 24.

Here, the diameter D23 of the transitional cylindrical portion 23 is smaller than the diameter D21 of the barrier portion 21 and larger than the diameter D24 of the lower neck portion 24. As shown in FIGS. 2 and 3, the transitional cylindrical portion 23 is curved or tapering.

It should be noted that smaller inaccuracies and variations in the diameter of the transitional portion 23 and the neck portion 22 are fully acceptable. However, the chamfered surfaces 20*a*, 20*b* and the side surface 20*c* will require a grinding and/or polishing process as required today in order to obtain a sufficient support and seal with respect to the seat 40. However, the invention is not limited to such a grinding and/or polishing process of the glass body, as it is believed that future sealing devices 30 may not require the same accuracy of the glass body as today.

It has been found that the hardening process will provide the best results when the thickness of the glass body is not variating too much. Hence, it is preferred that the height H21 of the barrier portion 21 is substantially equal to the diameter D24 of the lower neck portion 24. Moreover, the tapering end portion 25 should not be too thin, i.e. the diameter D25 should not be much smaller than the diameter D24.

In order to achieve an approximately homogenous thickness of the glass body, a recess 26 is provided centrally in the barrier portion 21 on the opposite side of the neck portion 22. As shown in FIG. 3, a thickness T is defined as the shortest distance through the glass body 20 between a point of the surface of the transitional cylindrical portion 23 and any point of the surface of the recess 26. The hickness T is substantially equal to the height H21 of the barrier portion 21 and/or the diameter D24 of the lower neck portion 22.

As shown in FIG. 3, the total height H20 of the glass body is more than twice the height H21 of the glass barrier portion 21. Preferably, the total height H20 is 3-6 times longer than the height H21.

Figure 4:
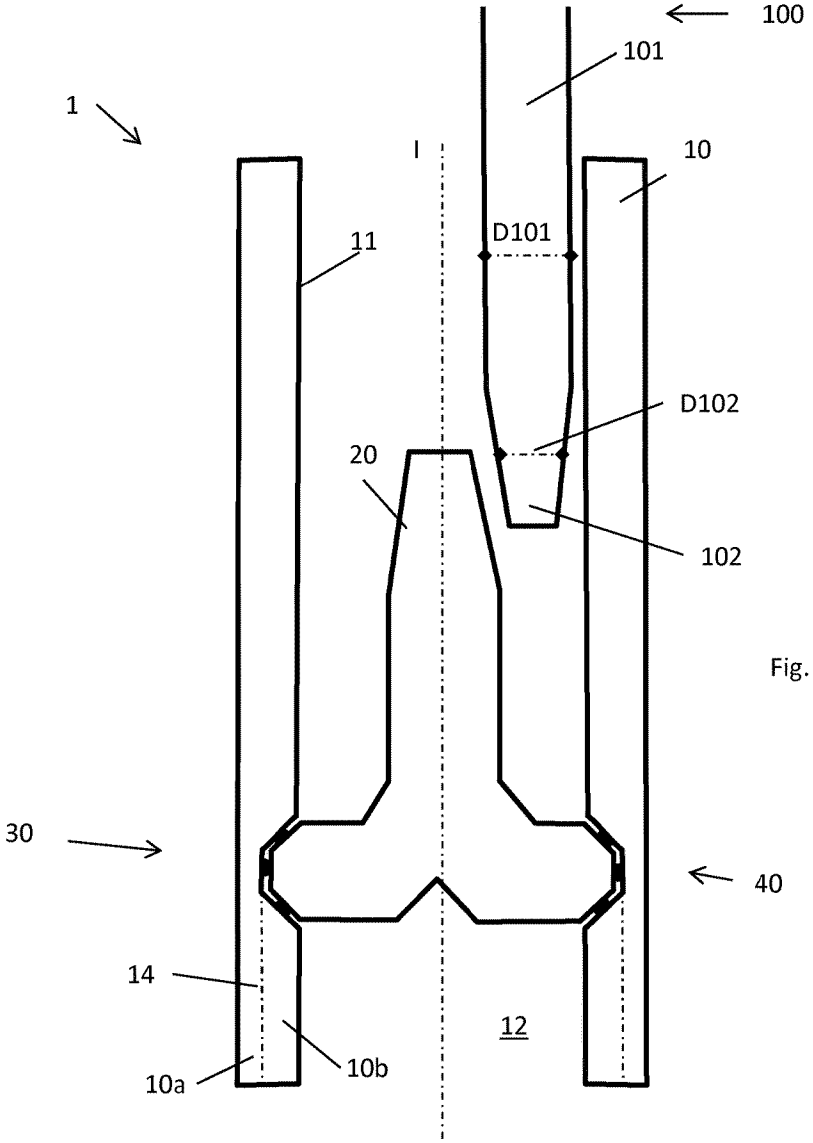
FIG. 4 illustrates how a disintegration tool may be used to disintegrate the glass body.

In FIG. 4, it is shown a well tool system comprising the above well tool device 1 and a disintegration tool 100 for disintegrating the frangible glass body 20. The disintegration tool 100 comprises an elongated body 101 configured to be inserted into the annular compartment provided radially between the outer surface of the neck portion 22 and the inner surface 11 of the housing 10. In FIG. 2, the annular compartment is indicated as dashed lines A25 and A24, and the total diameter of the bore 12 is indicated as dashed line D12.

Preferably, the disintegration tool 100 comprises a tapering end portion 102 having a diameter D102 being smaller than the diameter D101 of the elongated body 101.

As described above, either the diameter D102 of a part of the tapering end portion 102 or the diameter D101 of the elongated body 101 is smaller than either the available space A25 or A24 between the outer surface of the neck portion 22 and the inner surface 11 of the housing 10 in order to be inserted into the annular compartment.

Moreover, either the diameter D102 of a part of the tapering end portion 102 or the diameter D101 of the elongated body 101 is larger than available space A25 or A24 between the outer surface of the neck portion 22 and the inner surface 11 of the housing 10, as this will force the neck portion 22 sideways and initiate the disintegration of the frangible glass body 22 by breaking the neck portion 22. Such a hardened glass body 20 will shatter into small glass fragments when a part of the glass body 20 is broken in this way.

It is now referred to FIG. 5*a*. Here, the barrier portion 21 of the glass body 20 is similar to the one in FIG. 2, while the neck portion 22 here is tapering, i.e. the entire neck portion 22 is frustoconical. Hence, the neck portion 22 is here not considered to comprise two parts (as the above lower cylindrical portion 24 and a above upper tapering portion 25). The neck portion 22 here has a varying diameter D22.

This embodiment does not comprise an intermediate portion 23 between the barrier portion 21 and the neck portion 22, even though such an embodiment would be possible, as indicated by dashed lines 23.

It is now referred to FIG. 5*b*. Here, the barrier portion 21 of the glass body 20 is similar to the one in FIG. 2, while the entire neck portion 22 here is cylindrical with a constant diameter D22. This embodiment does not comprise an intermediate portion 23 between the barrier portion 21 and the neck portion 22, even though such an embodiment would be possible, as indicated by dashed lines 23.

It is now referred to FIGS. 6*a* and 6*b*. In this embodiment, the surfaces and transitions of the glass body are curved, i.e. the recess 26 has a curved surface, the intermediate portion 23 has a curved surface and the top end of the cylindrical neck portion 22 is hemispherical. Hence, the neck portion 22 can be considered to comprise a lower cylindrical portion 24 and an upper, curved tapering portion 25, alternatively an upper hemispherical portion 25. Of course, the tapering portions 20*a*, 20*b* are chamfered and not curved, as described above.

In FIG. 6*b*, the disintegration tool 100 is shown to be forced into the annular compartment between the outer surface of the neck portion 22 and the inner surface 11 of the housing 10, thereby causing the neck portion 22 to break at position X. In FIG. 6*b* this is illustrated as the glass body 20 has been separated into two parts. In reality, the glass body 20 will be disintegrated into small fragments immediately after the breaking of the neck portion 22.

As shown in FIG. 6, the tapering portion 102 of the disintegration tool 100 has a curved end portion.

It is now referred to FIG. 7. In this embodiment, the glass body 20 comprises a recess 27 provided circumferentially around the neck portion 22. The recess 27 is forming a weakened area of the glass body 20, where breaking is likely to occur.

Here, the housing 10 is provided inside a plug mandrel 16 having a top 15 to which a setting and/or retrieval tool can be connected. A ratchet and lock ring mechanism between the housing 10 and the plug mandrel 16 is indicated by numbers 16*a*, 16*b*.

The well tool device 1 described herein may be a part of a plugging device, such as a bridge plug. The housing 10 will then typically be a part of the mandrel of the plugging device. The well tool device 1 may also be a part of a completion string, where the purpose of the frangible glass body is used to pressure test the completion string, and when the frangible disc is removed in order to start the production from the well. The housing 10 will here typically be a part of the completion string. The well tool device 1 may also be a part of other well tools where a temporary barrier is needed.

It is now referred to FIG. 8*a*. Here, the housing 10 is fixed inside a pipe, for example a production tubing 17. Here, a protective substance 18, for example sand, is provided around and above the neck portion 22. The function of the sand is to protect the glass body 20 from debris falling into the well. As shown in FIG. 8*b*, debris falling into the well will not come into contact with the glass body.

Accordingly, the well tool device 1 is here used as a debris catcher.

In FIG. 8*c*, a bailing and disintegration operation has been performed. First, debris and the sand has been bailed out by a bailing tool. The bailing tool may be equipped with a disintegration tool 100, i.e. after the bailing operation, the bailing tool is lowered further into contact with the glass body in order to disintegrate the body 20. Alternatively, a separate disintegration tool 100 is used to perform the disintegration operation.

It is now referred to FIG. 9. Here, several glass bodies 20 are provided in a production tubing 17, either directly connected in seating devices provided in the production tubing, or in seating devices provided in separate housings 10, where the housings are fixed to the production tubing 17 again. A gas or a light-weight fluid is filled between each glass disc body. The purpose of the gas or light-weight fluid is to provide buoyancy of the horizontal section of the production tubing to reduce friction between the outer surface of the production tubing and its surroundings. Such friction has previously represented a limit for how long horizontal sections of a production tubing may be. When the production tubing is at the desired location, the glass bodies may be disintegrated to start production from the well.

Figure 10A:
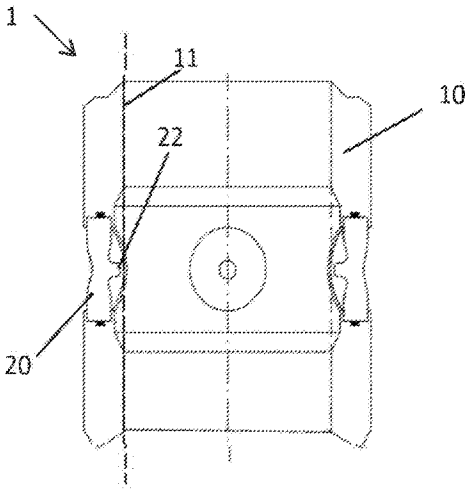
Figure 10B:
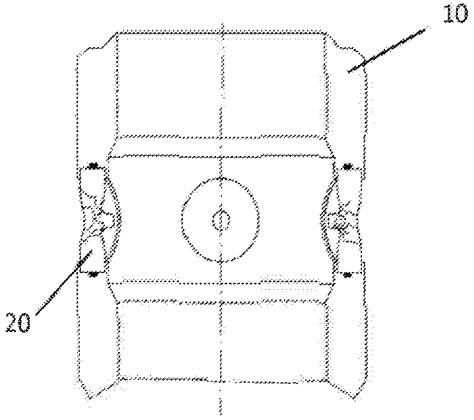
Figure 10C:
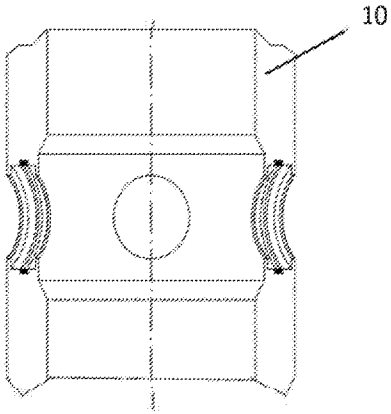

It is now referred to FIG. 10*a*-10*c*. Here, the housing 10 is a pre-perforated production tubing, where glass bodies 20 are provided in each perforation, where the neck portion 22 of the glass bodies 20 are faced radially inwards towards the center of the housing 10. In FIG. 10*a*, it is shown that the neck portion 22 has an height being much shorter than in the previous embodiments, it is shown that the neck portion 22 does not project further into the production tubing than the inner surface 11 of the housing 10. Hence, a long tool having a large diameter will not be able to come into contact with the neck portions. In order to disintegrate the glass body 20, a radially expanding disintegration tool 100 should be used.

Figure 10D:
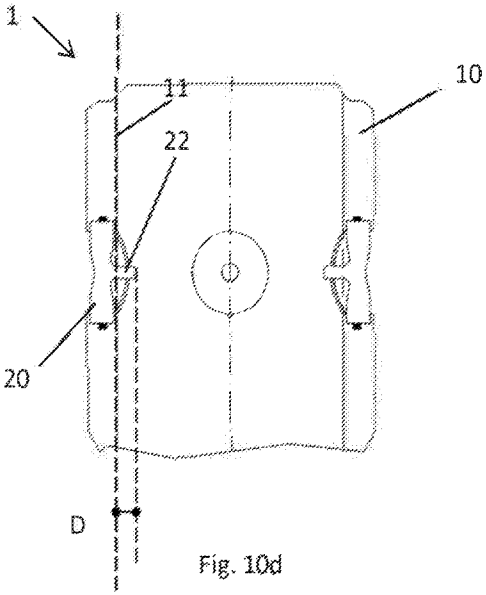
Figure 10E:
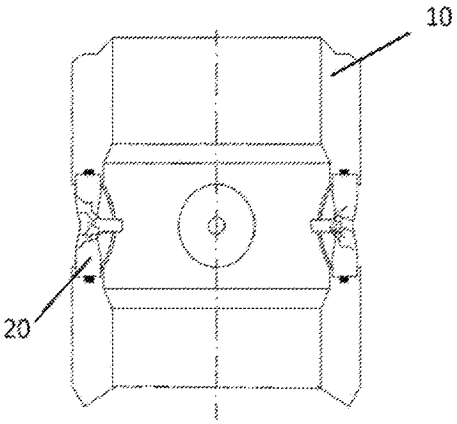
Figure 10F:
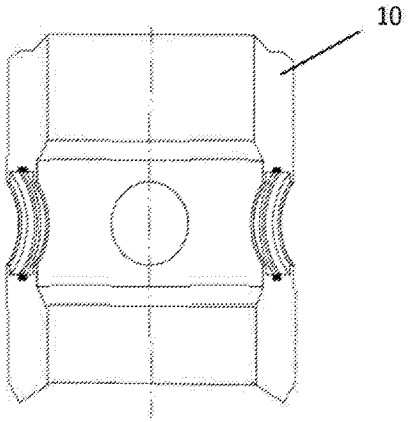

It is now referred to FIG. 10*d*-10*f*. This embodiment is substantially similar to FIG. 10*a*-10*c*, the only difference here is that the neck portion 22 is longer and projects a small distance D into the production tubing. Here, all glass bodies may be broken in one run by means of a suitable disintegration tool. Moreover, it is not needed to know the accurate position of each glass body to break it, as long as the disintegration tool has an outer diameter sufficient to come into contact with the neck portions 22 of the respective glass bodies.

In FIGS. 10*b* and 10*e*, the disintegration of the glass body 20 is illustrated. In FIGS. 10*c* and 10*f*, the remaining parts of the glass bodies 20 have been removed, and the production tubing is perforated and ready for production.

The invention claimed is:

1. A well tool device, comprising:

a housing having an inner surface defining a through bore;

a frangible glass body comprising upper and lower chamfered supporting surfaces;

a seat for supporting the frangible glass body in relation to the housing; and a sealing device provided between the frangible glass body and the seat;

wherein the frangible glass body is provided as one glass body comprising:

a barrier portion supported by the seat; and a neck portion protruding in the direction of the through bore, wherein a diameter of the neck portion is smaller than a diameter of the barrier portion, wherein the neck portion comprises an upper tapering neck portion and a lower neck portion, wherein the upper tapering neck portion has a diameter smaller than a diameter of the lower neck portion, and wherein a height of the barrier portion is substantially equal to the diameter of the lower neck portion.

2. The well tool device according to claim 1, wherein the barrier portion and the neck portion have a common longitudinal center axis.

3. The well tool device according to claim 1, wherein a transitional cylindrical portion is provided between the barrier portion and the neck portion, wherein a diameter of the transitional cylindrical portion is smaller than the diameter of the barrier portion and larger than the diameter of the neck portion.

4. The well tool device according to claim 3, wherein a recess is provided centrally in the barrier portion on an opposite side of the neck portion.

5. The well tool device according to claim 4, wherein a thickness is defined as a shortest distance through the glass body between a point of a surface of the transitional cylindrical portion and any point of a surface of the recess, wherein the thickness is substantially equal to a height of the barrier portion and/or the diameter of the neck portion.

6. The well tool device according to claim 1, wherein the neck portion is cylindrical or frustoconical.

7. The well tool device according to claim 1, wherein the frangible glass body is cylindrical symmetric around a longitudinal center axis.

8. A well tool system, comprising:

a well tool device, wherein the well tool device comprises:

a housing having an inner surface defining a through bore;

a frangible glass body comprising upper and lower chamfered supporting surfaces a seat for supporting the frangible glass body in relation to the housing; and a sealing device provided between the frangible glass body and the seat, wherein the frangible glass body is provided as one glass body comprising:

a barrier portion supported by the seat; and a neck portion protruding in the direction of the through bore, wherein a diameter of the neck portion is smaller than a diameter of the barrier portion; and a disintegration tool for disintegrating the frangible glass body, wherein the disintegration tool comprises an elongated body, wherein the elongated body is configured to be inserted into an annular compartment provided between an outer surface of the neck portion and the inner surface of the housing.

9. The well tool system according to claim 8, wherein the disintegration tool comprises a tapering end portion having a diameter being smaller than a diameter of the elongated body.

10. The well tool system according to claim 8, wherein the neck portion is cylindrical or frustoconical.

11. The well tool system according to claim 8, wherein the frangible glass body is cylindrical symmetric around a longitudinal center axis.

12. A well tool device, comprising:

a housing having an inner surface defining a through bore, wherein the housing is a production tubing comprising perforations;

frangible glass bodies provided in respective perforations of the housing; and a sealing device provided between each of the frangible glass bodies and the housing, wherein each of the frangible glass bodies is provided as one glass body comprising:

a barrier portion supported by the housing; and a neck portion faced radially inwards towards a center of the housing, wherein a diameter of the neck portion is smaller than a diameter of the barrier portion.

13. The well tool device according to claim 12, wherein each of the perforations of the housing form a seat for supporting each of the frangible glass bodies in relation to the housing.

14. The well tool device according to claim 12, wherein the neck portion does not project further into the production tubing than an inner surface of the housing.

15. The well tool device according to claim 12, wherein the neck portion projects a distance into the production tubing.

16. The well tool device according to claim 12, wherein the neck portion are faced radially inwards towards a central longitudinal axis of the housing.

17. The well tool device according to claim 12, wherein the barrier portion and the neck portion have a common center axis.

18. The well tool device according to claim 12, wherein a recess is provided centrally in the barrier portion on an opposite side of the neck portion.

* * * * *